United States Patent [19]

Woodle

[11] 4,053,744

[45] Oct. 11, 1977

[54] MEANS FOR CONTROLLING A SOLVENT REFINING UNIT

[75] Inventor: Robert A. Woodle, Nederland, Tex.

[73] Assignee: Texaco Inc., New York, N.Y.

[21] Appl. No.: 730,487

[22] Filed: Oct. 7, 1976

[51] Int. Cl.[2] ..... G06G 7/58; C10G 43/08; C10G 21/00

[52] U.S. Cl. ..... 364/501; 196/14.52; 208/DIG. 1; 208/33

[58] Field of Search ..... 235/151.12, 151.1, 151.13; 196/14.52, 14.5, 132; 208/28, 27, 33, 36, 311, DIG. 1, 313; 23/230 R, 230 A, 255 E

[56] References Cited

U.S. PATENT DOCUMENTS

| | | | |
|---|---|---|---|
| 3,546,107 | 12/1970 | Brown et al. | 235/151.12 X |
| 3,549,514 | 12/1970 | Brown et al. | 235/151.12 X |
| 3,718,809 | 2/1973 | Woodle | 235/151.12 |
| 3,972,779 | 8/1976 | Harrison | 235/151.12 X |

*Primary Examiner*—Joseph F. Ruggiero
*Attorney, Agent, or Firm*—Thomas H. Whaley; Carl G. Ries; Ronald G. Gillespie

[57] ABSTRACT

A solvent refining unit is controlled so that it has a maximum allowable solvent flow rate or a maximum allowable extract oil flow rate. The temperature of the extract-mix in the refining tower, the flow rate of the charge oil, the flow rate of the solvent and the flow rate of the extract oil are sensed by sensors which provide corresponding signals. A circuit provides signals corresponding to desired flow rates for the charge oil and the solvent and for a desired temperature for the extract-mix in the refining tower. The refining unit is operated in accordance with the desired signals so as to achieve either a maximum allowable flow rate for the solvent or a maximum allowable flow rate for the extract oil, or a maximum allowable flow rate for the refined oil, or a reduced charge oil flow rate for a fixed refined oil flow rate.

7 Claims, 7 Drawing Figures

MEANS FOR CONTROLLING A SOLVENT REFINING UNIT

BACKGROUND OF THE INVENTION

1. Field of the Invention

The present invention relates to computer control systems and, more particularly, to a computer control system for an oil refining unit.

2. Description Of The Prior Art

Heretofore, in controlling solvent refining units using control systems as described and disclosed in U.S. Pat. Nos. 3,666,931 (issued May 30, 1972), 3,686,488 (issued Aug. 22, 1972) and 3,718,809 (issued Feb. 27, 1973), all of which issued to R.A. Woodle, inventor of the present invention, and assigned to Texaco Inc., assignee of the present ivention, concern themselves with either obtaining optimum yields of refined oil and extract oil or obtaining a maximum yield. In those patents the solvent flow rate was considered a fixed parameter. The present invention differs from those patents by controlling the solvent flow rate as a variable and achieving control of parameters not previously controlled directly.

SUMMARY OF THE INVENTION

A solvent refining unit which treats charge oil with solvent in a refining tower to yield raffinate and extract-mix includes strippers which separate the solvent from the raffinate and from the extract-mix to provide refined oil and extract oil, respectively. The solvent is returned to the refining tower and the refined oil is subsequently dewaxed as required to become refined oil. The control system includes sensors sensing the flow rates of the charge oil, the extract oil and the solvent and providing corresponding signals. The temperature of the extract-mix in the refining tower is sensed by another sensor which provides a corresponding signal. A circuit connected to the sensors provides signals corresponding to a desired temperature for the extract-mix in the refining tower and to desired flow rates for the charge oil and the solvent in accordance with the signals from the sensors. The charge oil flow rate, the solvent flow rate and the temperature of the extract-mix are controlled in accordance with the signals from the circuit to achieve either a maximum allowable flow rate for the solvent or a maximum allowable flow rate for the extract oil, or a maximum allowable refined oil flow rate, or a reduced charge oil flow rate for a fixed refined oil flow rate.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustrative purposes only and are not to be construed as defining the limits of the invention.

DESCRIPTION OF THE INVENTION

Figure 1:
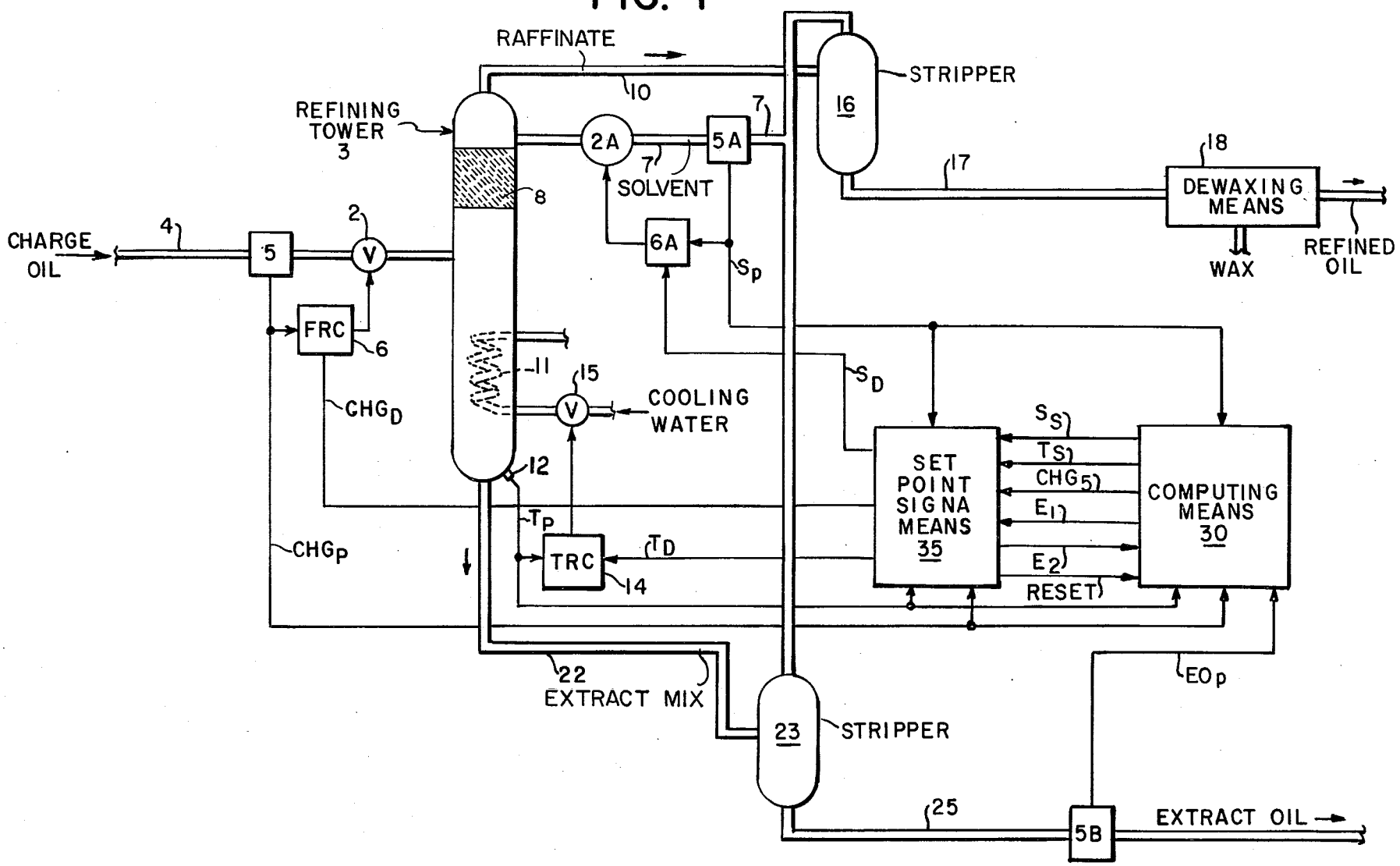
FIG. 1 is a simplified block diagram of a system, constructed in accordance with the present invention, for controlling a solvent refining unit, which is also partially shown in schematic form.

Referring to FIG. 1, there is shown a system for controlling a conventional type solvent refining unit. The rates of flow charge oil and solvent entering a refining tower 3 are controlled. The termperture of extract-mix, as the extract-mix leaves the refining tower 3, is also controlled. The rate of the charge oil entering the refining tower 3 in a line 4 is sensed and controlled by a conventional type sensing element 5, flow recorder controller 6 and valve 2. Sensing element 5 provides a signal $CHG_p$ to controller 6 corresponding to the flow rate of the charge oil in line 4. Controller 6 operates valve 2 to control the rate of flow of the charge oil to tower 3 in accordance with a difference between the signal from sensing element 5 and the position of its set point.

Although not shown, for ease of explanation, the charge oil and refining solvent entering tower 3 through lines 4 and 7, respectively, have been heated to a predetermined temperature. Sensing element 5A provides a signal $S_p$ to controller 6A corresponding to the flow rate of the solvent in line 7. Elements identified with a number and a letter suffix are silimar to elements having the same number without a suffix. Controller 6A operates valve 2A to control the solvent flow rate. Tower 3 contains packing 8 where the charge oil and solvent are contacted in counter flow, effecting the extraction of highly aromatic constituents of the charge oil. Raffinate, including refined oil and a small amount of dissolved solvent, is withdrawn through a line 10.

A temperature gradient is maintained in tower 3 by means of a cooling coil 11 having a cooling water flowing through it. The temperature in tower 3 is sensed by conventional type sensing means 12 which provides a corresponding signal $T_p$ to a temperature recorder controller 14. Temperature recorder controller 14, which may be of a type well known in the art, operates a valve 15 in accordance with a difference between the signal from temperature sensing means 12 and its set point position. Valve 15 controls the rate of flow of the cooling water so as to control the extract-mix temperature in tower 3.

Raffinate in line 10 enters a stripper 16 which strips the solvent from the raffinate to yield the refined oil. The solvent is returned to tower 3 by line 7, while the refined oil is provided to finishing means such as dewaxing means 18 through a line 17. Dewaxing means 18 removes the wax and provides refined dewaxed oil for storage and blending with product lubricating oil.

Extract-mix comprising solvent and dissolved, highly aromatic constituents of the charge oil is withdrawn from tower 3 through a line 22 at a temperature controlled by cooling coil 11. The extract-mix in line 22 is passed to a stripper 23 where the solvent is stripped from the extract oil which is discharged through a line 25. The recovered solvent is withdrawn thorugh line 7 for return to tower 3 and reused. A sensing element 5B senses the flow rate of the extract oil in line 25 and provides a corresponding signal $EO_p$.

Signals $CHG_p$, $S_p$, $T_p$ and $EO_p$ are provided by sensing elements 5, 5A, 12 and 5B, respectively, to computing means 30, while signals $CHG_p$, $S_p$ and $T_p$ are provided to set point signal means 35. Computing means 30, as explaned hereinafter, determines if the flow rates of the solvent and charge oil or the temperature of the extract-mix in the refining tower should be changed and provides a signal $E_1$ to set point signal means 35 to indicate whether a change should be made and signals $S_S$, $T_S$ and $CHG_S$ corresponding to a selected solvent flow rate, a selected temperature and a selected flow rate for the charge oil, respectively, to set point signal means 35. Set point signal means 35 in accordance with signal $E_1$ will provide signals to controller elements 6, 6A and 14 corresponding to the desired charge oil flow rate $CHG_D$, to the desired solvent flow rate $S_D$ and to the desired extract-mix temperature $T_D$, respectively. The operation of computing means 30 and set point signal means 35 is such that the solvent refining system shown in FIG. 1 is controlled so that there is a maximum solvent flow rate in line 7 or maximum allowable flow rate for the extract oil in line 25 or a maximum allowable refined oil flow rate in line 17, or a reduced charge oil flow rate in line 4 for a given refined oil flow rate.

The following equations are utilized in the control system:

$$C_P = EO(S+EO) \quad 1.$$

where $C_p$ is the estimated present position concentration of extract oil in the extract-mix, $EO_p$ and $S_p$ are the present position flow rates of the extract oil and solvent, respectively.

$$F_p = [(S)\ (K1)CHG] \quad 2.$$

where $F_p$ is the present position solvent dosage, K1 is a constant and CHG is the present position flow rate of the charge oil.

$$B = (C)\ (F)_{K2} \quad 3.$$

where B is a characteristic parameter for a given charge oil and a given refined oil quality and K2 is a constant.

$$AB = (K3\text{-}T_p)F_p^{K4} \quad 4.$$

where AB is a ratio of characteristic parameters for a given charge oil and a given refined oil quality, K3 and K4 are constants and $T_p$ is the present position temperature of the extract-mix leaving tower 3.

There are basically three cases of operations for the control system of the present invention which may occur. The first case is where the solvent flow rate and the extract oil flow rate are not at maximum rates. The second case is where the extract oil flows at a maximum rate. The third case is where the solvent refining unit is operated for a maximum solvent flow rate. Since the solvent is mixed with the extract oil leaving the refining tower 3 as extract-mix, there will be impressed on the refining unit another constraint known as the extract-mix recovery rate constraint which may occur before there is an actual constraint on the maximum extract oil flow rate so that the maximum allowable extract oil is not always constrained by its own maximum flow rate alone, but rather the combined flow rate of the extract oil and solvent in the form of the extract-mix flow rate.

Figure 2:
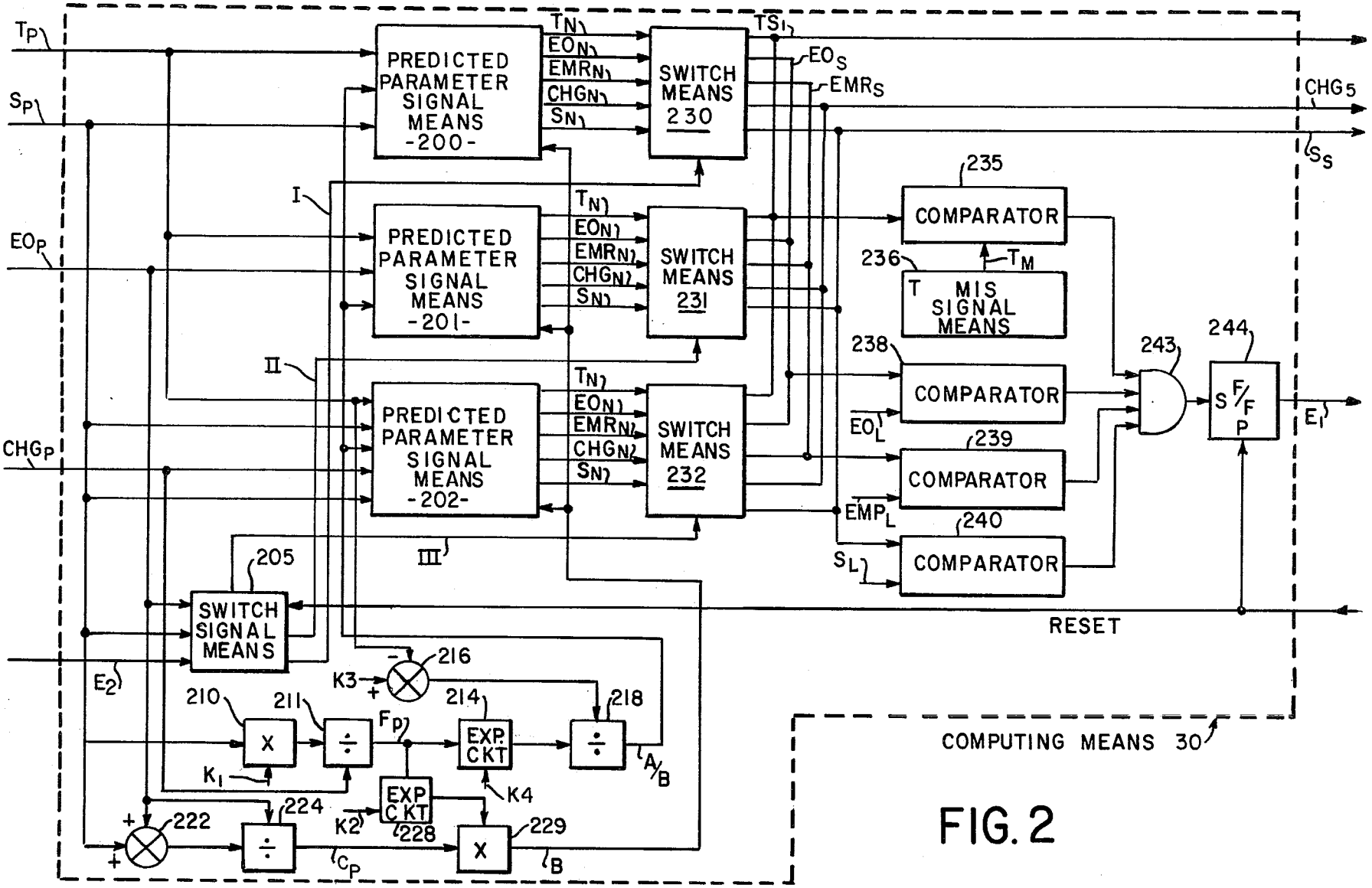
FIGS. 2 and 3 are detailed block diagrams of the computing means and the set point signal means shown in FIG. 1.

Referring now to FIG. 2, signal $T_p$ is provided to predicted parameter signal means 200, 201 and 202 in computing means 30, each of which provides signals corresponding to predicted values for certain parameters as hereinafter explained. Signal $S_p$ is provided to predicted parameter signal means 200 and 202. Signal $EO_p$ is applied to predicted signal means 201 and 202, while signal $CHG_p$ is provided to predicted parameter signal means 202. Signals $S_p$ and $EO_p$ are also applied to switch signal means 205 which provides signals I, II and III as hereinafter explained.

A multiplier 210 multiplies signal $S_p$ with a direct current voltage K1 to provide a signal to a divider 211. Direct current voltages identified as K with a numeral corresponding to the K terms in the equations, having the same numerals. Divider 211 divides the signal from multiplier 210 with signal $CHG_p$ to provide a signal corresponding to the term $F_p$ in accordance with equation 2. Signal $F_p$ is applied to an exponential circuit receiving a direct current voltage K4 and provides a signal corresponding to $F_p^{K4}$. Exponential circuit 214 may be of the type disclosed in U.S. Pat. No. 3,666,931, issued May 30, 1972. Substracting means 216 substracts signal $T_p$ from a direct current voltage K3 to provide a difference signal to a divider 218. Divider 218 divides the signal from substracting means 216 with the signal from exponential circuit 214 to provide a signal AB to predicted parameter signal means 200, 201 and 202.

Summing means 222 sums signals $EO_p$ and $S_p$ to provide a signal to a divider 224. Divider 224 divides the $EO_p$ signal with the signal from summing means 222 to provide a signal $C_p$ in accordance with equation 1.

Signal $F_p$ is applied to an exponential circuit 228 receiving the direct current voltage K2 and provides a signal to a multiplier 229 corresponding to $F_p^{K2}$. Multiplier 229 multiplies the signal from exponential circuit 228 with signal $C_p$ to provide a signal B to predicted parameter signal means 200, 201 and 202.

Each predicted parameter signal means provides signals $T_N$, $EO_N$, $EMR_N$, $CHG_N$ and $S_N$ corresponding to predicted extract-mix temperature, extract oil flow rate, extract-mix recovery rate, charge oil flow rate and solvent flow rate, respectively, for a particular condition as hereinafter explained. Predicted parameter signal means 200,201 and 202 provide signals $T_N$, $EO_N$, $EMR_N$, $CHG_N$ and $S_N$ to corresponding switch means 230, 231 and 232, respectively. Switch means 230, 231 and 232 are controlled by signals I, II and III, respectively, to provide the signals from predicted parameter signal means 200, 201 or 202 as signals $T_S$, $EO_S$, $EMR_S$ $CHG_S$ and $F_S$ corresponding to selected temperature, selected extract oil flow rate, selected extract-mix recovery rate, selected charge oil flow rate and selected solvent flow rate as hereinafter explained.

Signals $T_S$ is applied to a comparator receiving reference signal $T_M$ corresponding to a less than miscible temperature for oil solvent from $T_M$ signal means 236. Signal means 236 may be of the type described and disclosed in copending application, Ser. No. 730,488 filed on Oct. 7, 1976. Signal $T_M$ corresponds to a temperature sufficiently lower than the actual miscible temperature so as to prevent the extract-mix from reaching a miscible state as hereinafter explained. Comparators 238, 239 and 240 compare signals $EO_S$ and $S_S$, $EMR_S$ and $S_S$, respectively, with limit reference signals $EO_L$, $EMR_L$ and $S_L$, respectively, to provide comparison signal to an AND gate 243 also receiving the comparison signal from comparator 235. When all of the signals are within their constraint values. AND gate 243 provides a signal at a high level. Should any selected signal exceed a constraint value, the signal from AND gate 243 will go to a low level. The signal from AND gate 243 is provided to a flip-flop 244 providing signal $E_1$. Signal $E_1$ is at a high level when flip-flop 244 is in a clear state and at a low level when flip-flop 244 is in a set state. Flip-flop 244 is triggered to a set state by the signal from AND gate 243 going to a low level. Flip-flop 244 is reset by a reset pulse.

Figure 3:
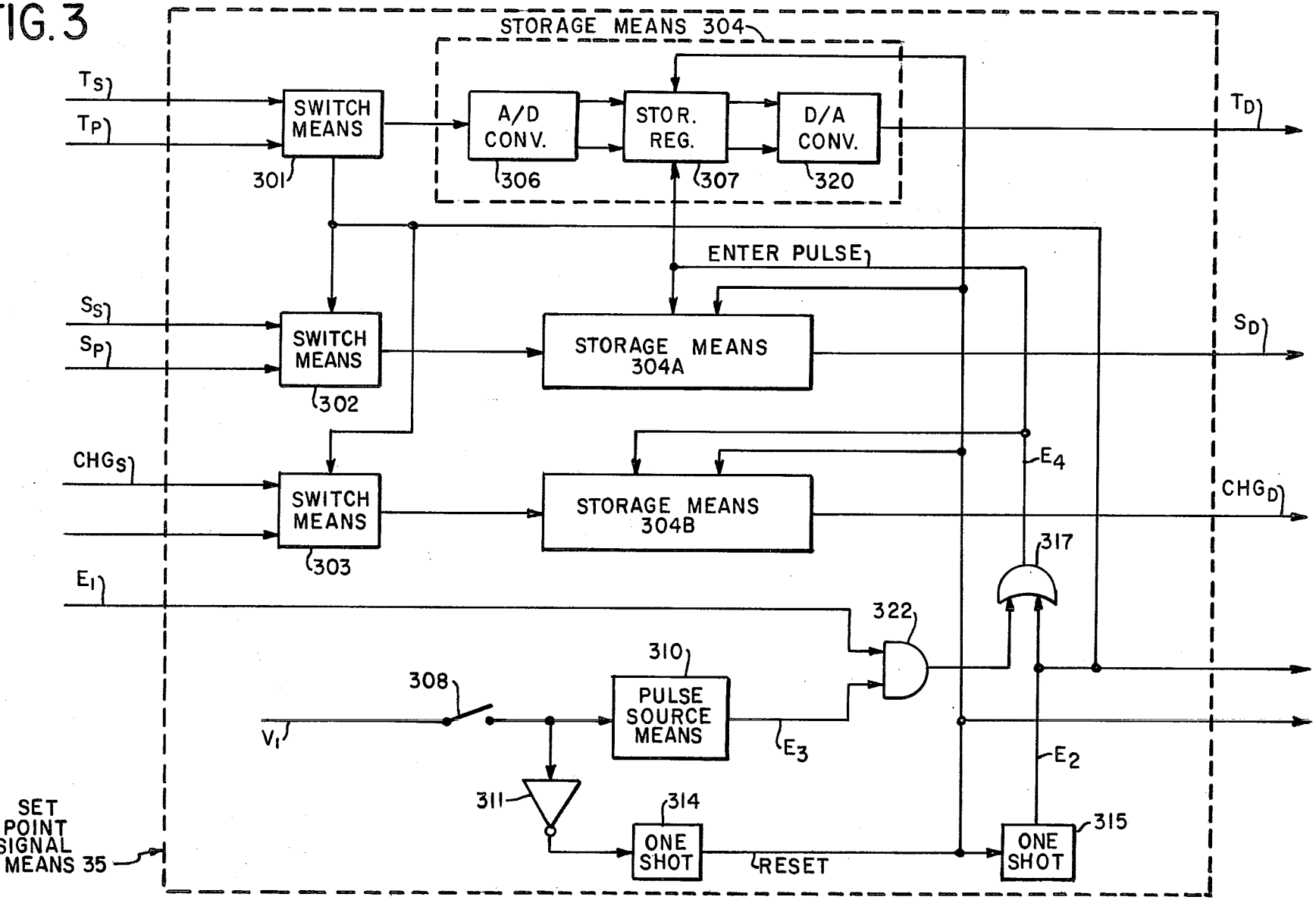

Referring now to FIG. 3, signals $T_S$, $S_S$ and $CHG_S$ are provided to switch means 301, 302 and 303, respectively, also receiving signals $T_P$, $S_P$ and $CHG_P$, respectively. The outputs from switch means 301, 302 and 303 are provided to storage means 304, 304A and 304B.

All of the storage means are identical and thus only a description of storage means 304 is necessary. The passed temperature signal from switch means 301 is applied to an analog-to-digital converter 306 where it is converted to digital signals and applied to a storage register 307. Storage register 307 will not enter the digital signals from converter 306 until it receives an "enter pulse" $E_4$. In initial operation an operator activates a switch 308 receiving a direct current voltage V1 which is applied to pulse source 310 and to an inverter 311. Inverter 311 provides a negative going voltage to a one-shot multivibrator 314 which provides a reset pulse that is provided to switch signal means 205 and to the storage registers in storage means 304, 304A and 304B. The reset pulse triggers another one-shot multivibrator 315 which provides a pulse $E_2$ which passes through an OR gate 317 to be provided as an initial "enter pulse" $E_4$ to registers 307 in storage means 304, 304A and 304B. Pulse $E_2$ is also provided to switch means 301, 302 and 303 causing them to pass signals $T_P$, $S_P$ and $CHG_P$, respectively, so that the digital signals stored initially correspond to the analog signals $T_P$, $S_P$ and $CHG_P$. Register 307 provides digital signals to a digital-to-analog converter 320 which, in turn, provides an analog signal $T_D$ corresponding to a desired temperature for the extract-mix which initially is the present position temperature. After the termination of pulse $E_2$, signal $T_D$ will correspond to stored signal $T_S$. Signal $T_D$, as noted before, is provided to the temperature recorder controller 14. Similarly, storage means 307A and 307B provide signals $S_D$ and $CHG_D$, initially corresponding to signals $S_P$ and $CHG_P$, respectively, to controllers 6A and 6, respectively.

As noted previously, when the solvent flow rate, the extract flow rate, the extract-mix temperature and extract-mix recovery rate are within their constrained values, signal $E_1$ is at a high level and an AND gate 322 is enabled to pass pulses from pulse source 310. Pulse source 310 provides pulses $E_3$ with sufficient time between pulses to allow the system to stabilize. Each pulse $E_3$ from pulse source 310 passes through AND gate 322, when enabled, and through OR gate 317 to become "enter" pulses $E_4$ and enter the digital signals as hereinbefore explained for pulse $E_2$ from one-shot 315.

When one or more parameter exceeds its constraint value, signal $E_1$ goes to a low level, thereby disabling AND gate 322 to maintain signals $T_{D,\,SD}$ and $CHG_D$ at their last values prior to a constraint value being exceeded.

Figure 4:
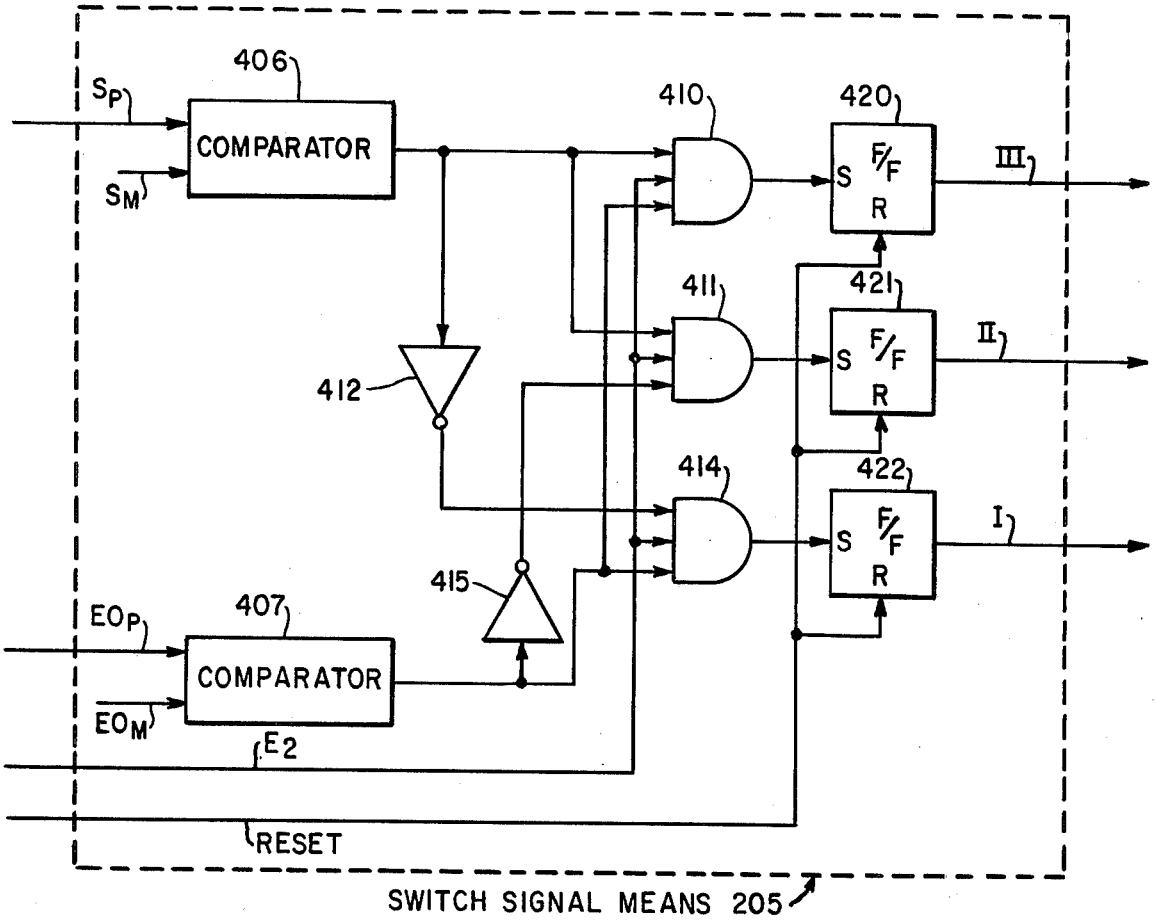
FIGS. 4 through 7 are detailed block diagrams of the switch signal means and the three predicted parameter signal means shown in FIG. 2.

Referring to FIG. 4, signal $S_P$ is applied to a comparator 406 which compares it with a reference signal $S_M$ corresponding to a value slightly less than the constraint limit for the solvent flow rate. Similarly, comparator 407 compares a signal $EO_P$ with a reference signal $EO_M$ corresponding to a value slightly less than the constraint limit for the extract oil flow rate. Comparators 406, 407 provide high level inputs when the signals $S_P$ and $EO_P$, respectively, do not exceed the reference values. When one of the signals exceeds a reference value, its corresponding comparator provides a low level signal.

The signal from caparator 406 is applied to AND gates 410, 411 and to an inverter 412. The signal from comparator 407 is applied to AND gates 410, 414 and to an inverter 415. The output of inverters 412, 415 are provided to AND gates 414 and 411, respectively. AND gates 410, 411 and 412 also receive pulse $E_2$. The output of AND gates 410, 411 and 412 are provided to flip-flops 420, 421 and 422 which provide signals III, II and I, respectively.

For the first case, where the solvent flow rate is limiting, comparator 406 provides a low level output while comparator 407 provides a high level output. Under this condition, AND gate 414 is enabled and pulse $E_2$ from one-shot 315 passes through AND gate 414 to trigger flip-flop 422 to a set state, causing it to provide signal I at a high level. Similarly, when the extract oil flow rate is at a limiting value, comparator 407 provides a low level signal while comparator 406 provides a high level signal. Under this condition, AND gate 411 is enabled so that pulse $E_2$ triggers flip-flop 421 to a set condition causing flip-flop 421 to provide signal II at a high level.

For the condition where neither the solvent flow rate nor the extract oil flow rate is at a limiting value, comparators 406 and 407 provide high level outputs which enable AND gate 410 to pass pulse $E_2$ to flip-flop 420. Flip-flop 420 is triggerred by the passed pulse $E_2$ to provide signal III at a high level.

Figure 5:
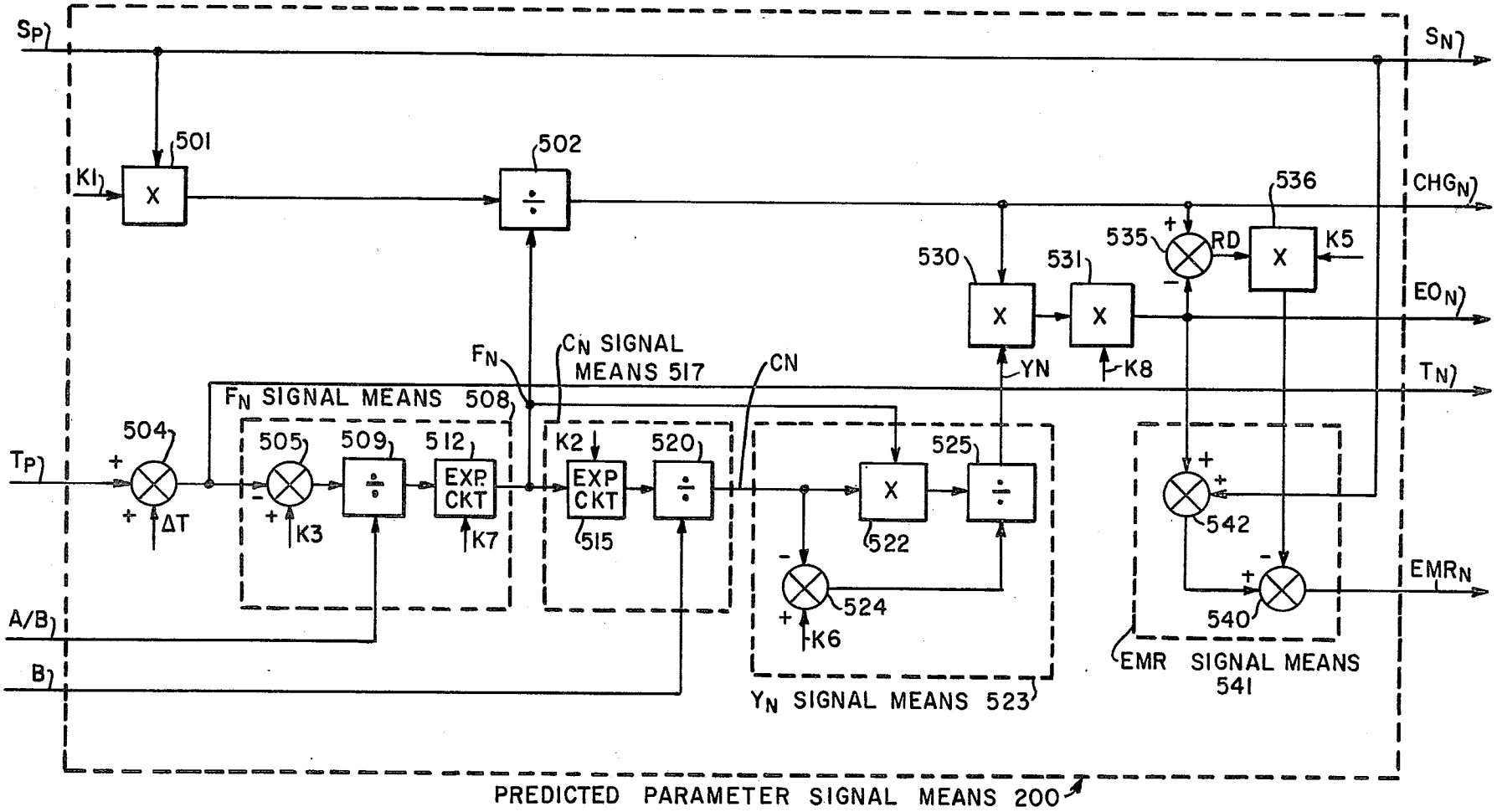

Referring now to FIG. 5, and assuming the condition that the solvent flow rate is limiting, predicted parameter signal means 200 receives signal $S_P$ and provides it as signal $S_N$, which indicates that the solvent flow rate will not change for the new condition. Signal $S_P$ is also provided to a multiplier 501 where it is muliplied with voltage K1 to provide a signal to a divider 502. Signal $T_p$ has a direct current voltage $\Delta T$ added to it by summing means 504 to provide a temperature signal $T_N$ for the new condition. Signal $T_N$ is also substracted from voltage K3 by substracting means 505 within $F_N$ signal means 508. Signal means 508 provides a signal $F_N$ in accordance with the following equation:

$$F_N = [(K3\text{-}T_N)(AB)]^{K7}$$

where constant K7 has a preferred value of 1.72. The difference signal is applied to a divider 509 where signal AB is divided into it to produce a signal which is applied to an exponential circuit 512. Exponential circuit 512 within $F_N$ signal means 508 provides signal $F_N$ in accordance with the signal from divider 509 and direct current voltage K7.

Signal $F_N$ is applied to divider 502 where it is divided into the signal from multiplier 501 to provide a new charge oil flow rate signal $CHG_N$ in accordance with the equation $CHG_N = (S_P)K1F_N$.

Signal $F_N$ is also applied to an exponential circuit 515 in $C_N$ signal means 517 receiving voltage K2 to provide a signal to a divider 520. Signal means 517 provides a signal $C_N$ in accordance with the following equation:

$$C_N = B(F_N)^{K2}.$$

Divider 520 divides the signal from exponential circuit 515 with signal B to provide signal $C_N$. Signal $C_N$ is provided to a multiplier 522 and to summing means 524 in $Y_N$ signal means 523. Signal means 523 provides a signal $Y_N$ corresponding to a new yield in accordance with the following equation:

$$Y_N = (F_N)\,(C_N)\,(K6\text{-}C_N).$$

substracting means 524 substracts signal $C_N$ from a direct current voltage K6 while multiplier 522 multiplies signal $C_N$ with signal $F_N$. The signal from multiplier 522 is divided by the signal from substracting means 524 by a divider 523 to provide signal $Y_N$.

Signals $CHG_N$ and $Y_N$ are multiplied by a multiplier 530 to provide a signal to another multiplier 531. Multiplier 531 multiplies the signal from multiplier 530 with a direct current voltage K8 to provide a signal $EO_N$ corresponding to the extract oil flow rate for the new condition. Substracting means 535 substracts signal $EO_N$ from signal $CHG_N$ to provide a signal $RO_N$ to a multiplier 536. Multiplier 536 multiplies signal $RO_N$ with voltage K5 to provide a signal to substracting means 540 within $EMR_N$ signal means 541. Signal means 541 provides a signal $EMR_N$ corresponding to a new extract-mix recovery rate in accordance with the following equation:

$$EMR = S_N + EO_N - (K5)(EO_N).$$

Summing means 542 in $EMR_N$ signal means 541 sums the signals Sp and $EO_N$. Substracting means 540 substracts the signal from multiplier 536 from the signal provided by summing means 542 to provides signal $EMR_N$.

Figure 6:
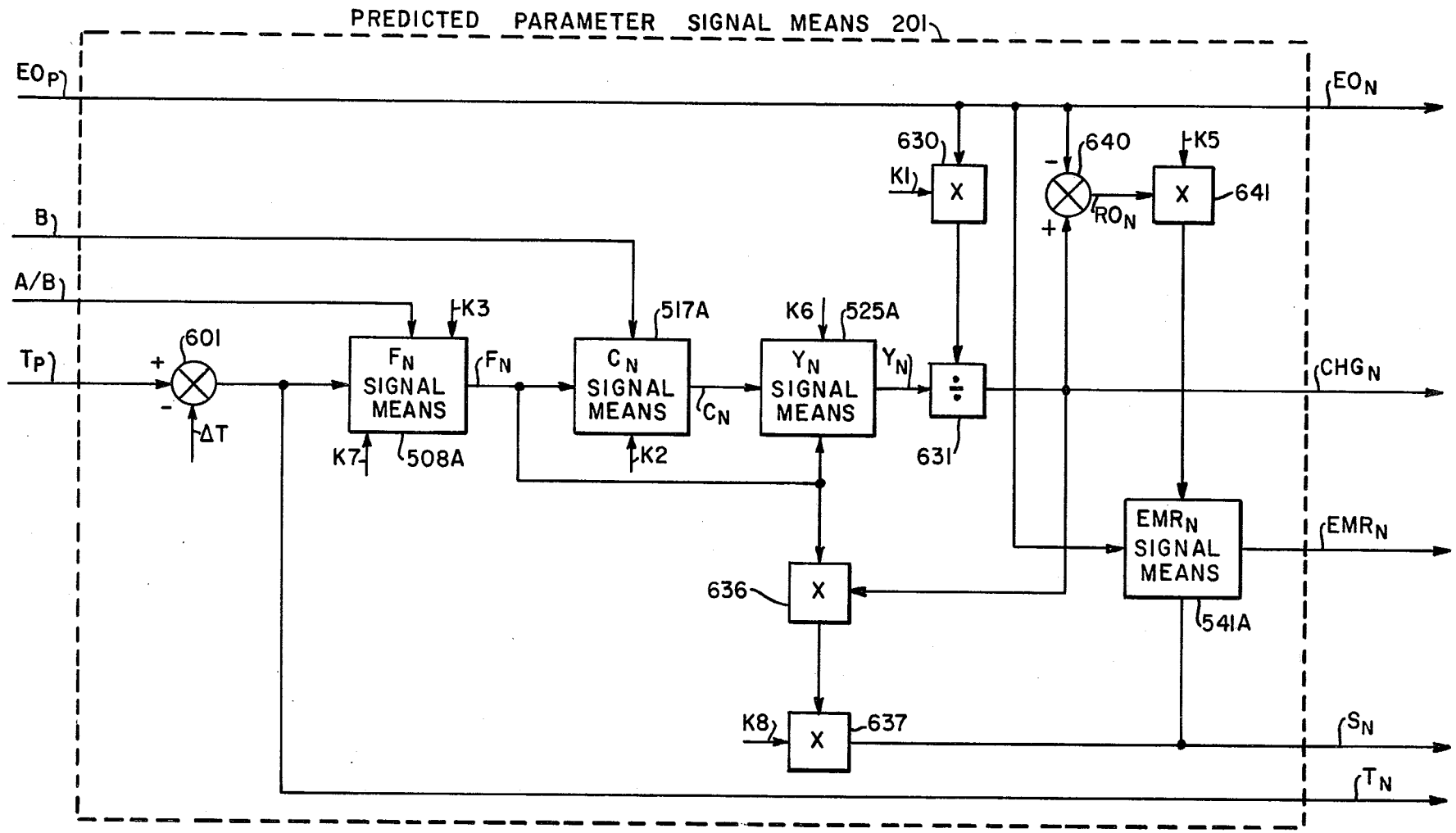

For the second case where the extract oil flow rate is limiting, and referring to FIG. 6, signal $EO_P$ passes through predicted parameter signal means 201 to be provided as signal $EO_N$ so that the extract oil flow rate for the new condition is the same as the previous condition. Substracting means 601 substracts voltage $\Delta T$ from signal $T_P$ to provide the temperature signal $T_N$ for the new condition. Signal $T_N$ is also applied to $F_N$ signal means 508A receiving signal AB and providing signal $F_N$ to $C_N$ signal means, 517A to $Y_N$ signal means 525A and to a multiplier 636. $C_N$ signal means 517A receives signal B and provides signal $C_N$ to $Y_N$ signal means 525A. Signal $EO_P$ is applied to a multiplier 630 where it is multiplied with voltage K1 to provide a signal to a divider 631. Divider 631 divides the signal from multiplier 630 with the signal $Y_N$ to provide a signal $CHG_N$ corresponding to the new charge oil flow rate.

Multiplier 636 multiplies signal $F_N$ with signal $CHG_N$ to provide a signal to another multiplier 637. Multiplier 637 multiplies the signal from multiplier 636 with voltage K8 to provide signal $S_N$ corresponding to the new solvent flow rate.

Substracting means 640 substracts signal $EO_N$ from signal $CHG_N$ to provide a signal corresponding to the new refined oil flow rate $RO_N$ to a multiplier 641. Multiplier 641 multiplies the signal $RO_N$ with voltage K5 to provide a product signal. $EMR_N$ signal means 541A provides the signal $EMR_N$ corresponding to the new extract-mix recovery rate in accordance with signals $S_N$, $EO_N$ and the signal from multiplier 641.

Figure 7:
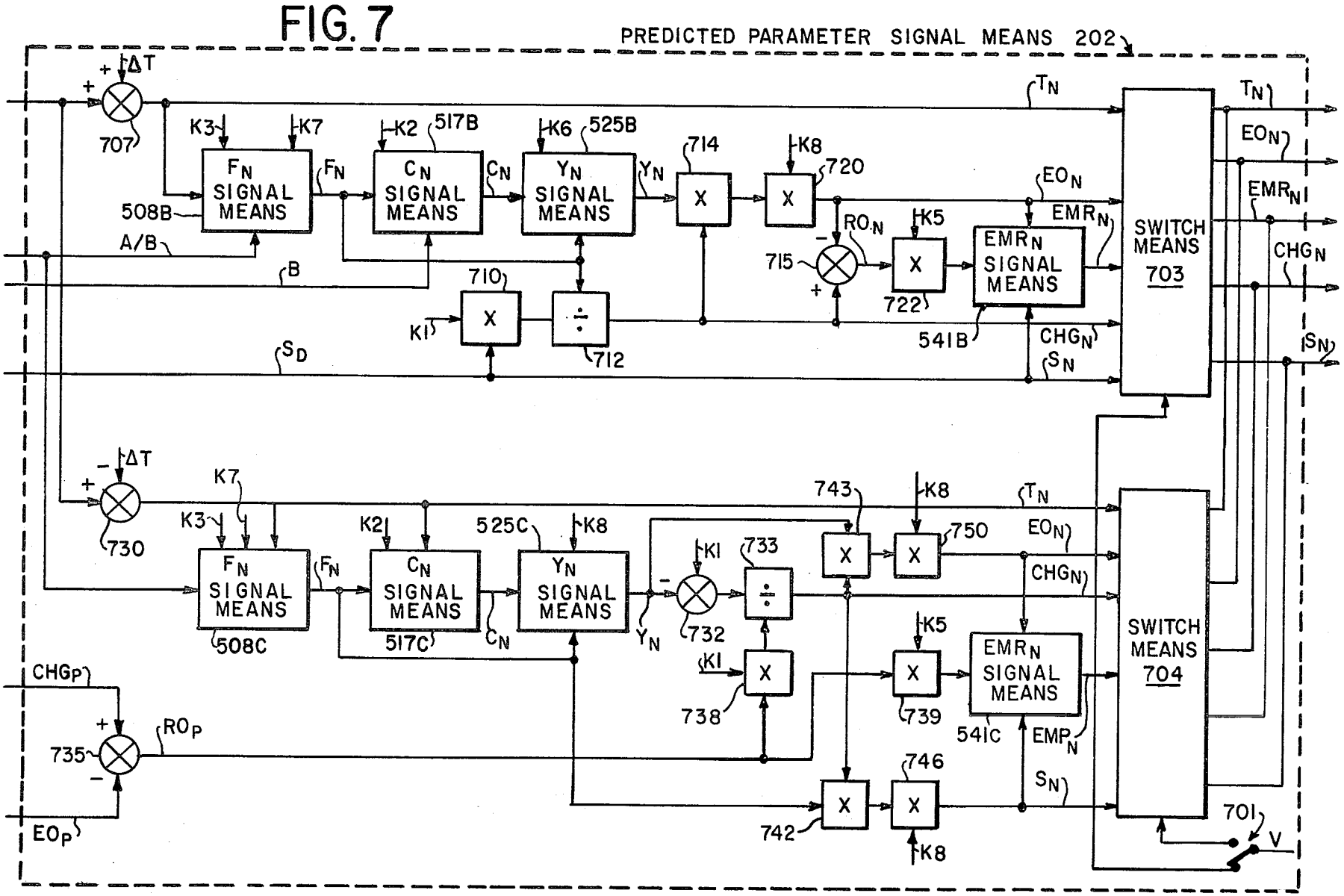

For the case where neither the solvent flow rate nor the extract oil flow rate is limiting, and referring to FIG. 7, the operator is faced with the choice of maintaining the refined oil flow rate but with reduced charge oil requirements or increasing refined oil flow rate until it reaches a constraint value which may be a system constraint value or what is the maximum desired to be produced. The operator exercises this decision by activation of a switch 701 which will enable either switch means 703 to provide the parameter signals for a case where the solvent flow rate is maintained constant and the charge oil flow is reduced, or switch means 704 which will maintain the refined oil rate constant while varying the solvent flow rate. Assuming that the operator has selected to enable switch means 703, the signals it passes are derived as follows: Signal $T_P$ is provided to summing means 707 where voltage $\Delta T$ is added to it to provide signal $T_N$, corresponding to the new temperature signal, to switch means 703. $F_N$ signal means 508B, receiving signals AB and $T_N$, provides signal $F_N$ as previously explained. $C_N$ signal means 517B, receiving signals $F_N$ and B, provides signal $C_N$ as previously explained; while $Y_N$ signal means 525B, receiving signals $F_N$ and $C_N$ provides signal $Y_N$ as previously explained.

Signal $S_P$ is provided to a multiplier 710, to EMR signal means 541B and to switch means 703 as signal $S_N$. Multiplier 710 multiplies signal $S_P$ with voltage K1 to provide a product signal. A divider 712 divides signal $F_N$ with the signal from multiplier 710 to provide a new flow rate signal $CHG_N$ for the charge oil to a multiplier 714 to substracting means 715, and to switch means 703. Multiplier 714 multiplies the $Y_N$ and $CHG_N$ signals to provide a signal which is multiplied with voltage K8 by another multiplier 720. Multiplier 720 provides a signal $EO_N$, corresponding to a new extract oil flow rate, to switch means 703 and to subtracting means 715 where it is substracted from signal $CHG_N$. A multiplier 722 multiplies the signal from subtracting means 715 with voltage K5 to provide a signal to $EMR_N$ signal means 541B. Signal means 541B provides a signal $EMR_N$, corresponding to a new extract-mix recovery rate, to switch means 703.

The signals passed by switch means 704 are developed as follows: substracting means 730 substracts voltage $\Delta T$ from signal $T_P$ to provide a signal $T_N$, corresponding to a new temperature, to $F_N$ signal means 508C. $F_N$ signal means 508C also receives signal AB and voltages K3, K7 and provides signal $F_N$. $C_N$ signal means 517C provides signal $C_N$ in accordance with signals B and $F_N$ and voltage K2. $Y_N$ signal means 525C provides signal $Y_N$ in accordance with the signals $C_N$, $F_N$ and voltage K6. Subtracting means 732 subtracts signal $Y_N$ from voltage K1 and provides a signal to a divider 733.

Substracting means 735 subtracts signal $EO_P$ from signal $CHG_P$ to provide signal $RO_P$, corresponding to the present position of the refined oil flow rate, to multipliers 738, 739. Multiplier 738 multiplies signal $RO_P$ with voltage K1 to provide a signal to divider 733. Divider 733 divides the signal from multiplier 738 by signal from subtracting means 732 to provide a signal $CHG_N$, corresponding to a new charge oil flow rate, to switch means 704 and to multipliers 742, 743.

Multiplier 742 multiplies signal $CHG_N$ with signal $F_N$ to provide a signal to another multiplier 746 where it is multiplied with voltage K8 to provide signal $S_N$, corresponding to a new solvent flow rate, to switch means 704. Multiplier 739 multiplies signal $RO_P$ with voltage K5 to provide a signal to $EMR_N$ signal means 541C.

Multiplier 743 multiplies signal $CHG_N$ with signal $Y_N$ to provide a signal to another multiplier 750 where it is multiplied with voltage K8 to provide a signal $EO_N$, corresponding to a new extract oil flow rate, the EMR signal means 541C toi switch means 704. $EMR_N$ signal means 541C provides signal $EMR_N$ in accordance with signals $EO_N$, $S_N$ and the signal from multiplier 739. When enabled, switch means 704 passes signal $T_N$, $EO_N$, $CHG_N$, $EMR_N$ and $S_N$.

What is claimed is:

1. A control system for a solvent refining unit which treats charge oil with a solvent in a refining tower to yield raffinate and extract-mix, strippers separate the solvent from the raffinate and extract-mix to provide refined waxy oil and extract oil, respectively, the solvent is returned to the tower and the refined waxy oil is subsequently dewaxed to provide refined oil, comprising temperature sensing means for sensing the temperature of the extract-mix in the refining tower and providing a signal $T_P$ corresponding thereto; charge oil sensing means for sensing the flow rate of the charge oil and providing a corresponding signal $CHG_P$; extract oil sensing means for sensing the flow rate of the extract oil and providing a signal $EO_P$ representative thereof; solvent sensing means for sensing the flow rate of the solvent and providing a signal $S_P$ corresponding thereto; signal means connected to all the sensing means for providing signals $T_D$, $CHG_D$ and $S_D$ corresponding to a desired temperature for the extract mix in the refining tower, to a desired flow rate for the charge oil and to a desired flow rate for the solvent in accordance with signals $CHG_P$ and $T_P$ and $EO_P$ so as to operate the refining unit to achieve either a maximum allowable flow rate for the solvent, or a maximum allowable flow rate for the extract oil or a maximum allowable refined oil flow rate or a reduced charge oil flow rate for fixed refined oil flow rate; and control means connected to the signal means for controlling the charge oil flow rate, the refining tower extract mix temperature and the solvent flow rate in accordance with signals $CHG_D$, $S_D$ and $T_D$.

2. The system as described in claim 1, in which the signal means includes control signal means connected to the extract oil sensing means and to the solvent means for providing three control signals, a first control signal being of one amplitude when the solvent flow rate is at a maximum allowable value and at another amplitude when the solvent flow rate is not at its maximum allowable value, a second control signal at one amplitude when the extract oil flow rate is at its maximum allowable value and at another amplitude when the extract oil is not at its maximum allowable value and a third control signal at one amplitude when neither the extract flow rate nor the solvent flow rate is at a maximum allowable value, and at another amplitude when either the extract oil flow rate or the solvent flow rate is at a maximum allowable value; $F_P$ signal means connected to the solvent sensing means and to the charge oil sensing means and receiving a direct current voltage K1 for providing a signal $F_P$ corresponding to the present position of the solvent dosage in accordance with signals $S_P$ and $CHG_P$, voltage K1 amd the following equation:

$$F_P = (S_P)\,(K1)CHG_P;$$

signal means connected to the solvent sensing means and to the extract oil sensing means for providing a signal $C_P$, corresponding to present position estimated in accordance with signals $EO_P$ and $S_P$ and the following equation:

$$C_P = EO_P(S_P + EO_P);$$

B signal means connected to the $C_P$ signal means and to the $F_P$ signal means and receiving a direct current voltage K2 for providing a signal B, corresponding to a characteristic parameter for a given charge oil and a given refined oil quality, in accordance with signals $C_P$ and $F_P$, voltage K2 and the following equation:

$$B = (C_P)\,(F_P)^{K2};$$

AB signal means connected to the temperature sensing means and to the $F_P$ signal means and receiving direct current voltages K3 and K4 for providing a signal AB, corresponding to a ratio of characteristic parameters for a given charge oil and given refined oil quality, in accordance with signals $T_P$ and $F_P$, voltages K3 and K4 and the following equation:

$$AB = (K3\text{-}T_P)(F_P)^{K4};$$

first predicted parameter signal means connected to the temperature sensing means, to the solvent sensing means, to the AB signal means and to the B signal means for providing signals $T_N$, $EO_N$, $EMR_N$, $CHG_N$ and $S_N$ corresponding to a new extract-mix temperature, a new extract oil flow rate, a new extract mix recovery rate, a new charge oil flow rate and a new solvent flow rate, respectively, in accordance with signals $T_P$, $S_P$, AB and B, second predicted parameter signal means connected to the temperature sensing means, to the extract oil sensing means, to the AB signal means and to the B signal means for providing signals $T_N$, $EO_N$, $EMR_N$, $CHG_N$ and $S_N$ in accordance with signals $T_P$, $EO_P$, AB and B; third predicted parameter signal means connected to the temperature sensing means, to the extract oil sensing means, to the charge oil sensing means and to the solvent sensing means, to the AB signal means and to the B signal means for providing signals $T_N$, $EO_N$, $EMR_N$, $CHG_N$, in accordance with signals $T_P$, $S_P$, $EO_P$, AB and B; first switching means connected to all the predicted parameter signal means for passing signals provided by the first predicted parameter signal means while blocking the signals provided by the second and third predicted parameter signal means when the first control signal is of the one amplitude, for passing the signals provided by the second predicted parameter signal means while blocking the signals provided by the second predicted parameter signal means while blocking the signals provided by the first and third predicted parameter signal means when the second control signal is of the one amplitude and for passing signals provided by the third predicted parameter signal means while blocking the signals provided by the first and second predicted parameter signal means when the third control signal is of the one amplitude, said first switching means providing the passed signals as signal $T_S$, $EO_S$, $EMR_S$, $CHG_S$ and $S_S$ corresponding to a selected temperature for the extract-mix, a selected flow rate for the extract oil, a selected recovery rate for the extract-mix, a selected charge oil flow rate and a selected solvent flow rate; means for receiving signals $EO_S$, $EMR_S$ and $F_S$ for providing a fourth control signal of one amplitude when none of the signals $T_S$, $EMR_S$, $EO_S$ and $S_S$ exceed a constraint value and of another amplitude when at least one of the signals $T_S$, $EMR_S$, $EO_S$ and $S_S$ exceed a constraint value; and set point signal means connected to the first switching means for providing signals $T_D$, $CHG_D$, $S_D$ in accordance with signals $T_B$, $CHG_S$, $F_S$ and the fourth control signal.

3. A system as described in claim 2 in which the set point signal means includes a plurality of storage means, one storage means receiving signal $T_S$, another storage means receiving signal $S_S$ and a third storage means receiving signal $CHG_S$, for storing the received signals in response to an enter pulse and for the first storage means to provide signal $T_D$ in accordance with its stored signal, for the second storage means to provide signal $S_D$ in accordance with its stored signal and for the third storage means to provide $CHG_D$ in accordance with its stored signal; means connected to all the storage means and to the computing means for providing the enter pulse when the fourth control signal is of the one amplitude and not providing the enter pulse when the fourth control signal is of the other amplitude.

4. A system as described in claim 3 in which the set point signal further comprises second switching means receiving signals $T_S$, $S_S$, $CHG_S$ from the first switching means and signals $T_P$, $S_P$, $CHG_P$ from the temperature sensing means, solvent sensing means and the charge oil sensing means for passing signals $T_P$, $S_P$ and $CHG_P$ to their corresponding storage means in response to an initial enter pulse while blocking signals $T_S$, $S_S$ and $CHG_S$ and for passing signals $T_S$, $S_S$ and $CHG_S$ to storage means while blocking signals $T_P$, $S_P$ and $CHG_P$ during the absence of an initial enter pulse so that during the initial operation signals $T_D$, $S_D$, $CHG_D$ correspond to signals $T_P$, $S_P$, $CHG_P$, respectively; and means for providing a reset pulse at the initiation of the system's operation.

5. A system as described in claim 4 in which the first predicted parameter signal means includes first conductive means connected to the solvent sensing means and to the second switching means for providing signal $S_P$ to the second switching means as signal $S_N$, first $T_N$ signal means connected to the temperature sensing means and to the second switching means and receiving a direct current voltage $\Delta T$, corresponding to a predetermined change in temperature, for providing a signal $T_N$, corresponding to a new increased temperature, to the second switching means in accordance with signal $T_P$ and voltage $\Delta T$; first $F_N$ signal means connected to the first $T_N$ signal means and to the AB signal means and receiving direct current voltages K3 and K7, corresponding to constants, in accordance with the signals $T_N$ and AB, voltages K3 and K7 and the following equation:

$$F_N = [K3\text{-}T_N)(AB)]^{K7};$$

first $CHG_N$ signal means connected to the solvent sensing means, to the first $F_N$ signal means and to the second switching means and receiving a direct current voltage K1, corresponding to a constant, for providing a signal $CHG_N$, corresponding to a new charge oil flow rate, to the second switching means in accordance with signals $S_P$ and $F_N$, voltage K1 and the following equation:

$$CHG_N = (K1)\ (S_P)(F_N);$$

first $C_N$ signal means connected to the first $F_N$ signal means and to the B signal means and receiving a direct current voltage $K_2$, corresponding to a constant, for providing a signal $C_N$ in accordance with signals B and $F_N$, voltage K2 and the following equation:

$$C_N = B(F_N)^{K2};$$

first $Y_N$ signal means connected to the first $F_N$ signal means and the first $C_N$ signal means and receiving a direct current voltage K6, corresponding to a constant, for providing a signal $Y_N$ in accordance with signal $F_N$ and $C_N$, voltage K5 and the following equation:

$$Y_N = (F_N)\ (C_N)/(K6-C_N);$$

first $EO_N$ signal means connected to the first $CHG_N$ signal means, to the first $Y_N$ signal means and to the second switching means and receiving a direct current voltage K8, corresponding to a constant, for providing signal $EO_N$, corresponding to a new extract oil flow rate, to the second switching means in accordance with signals $CHG_N$ and $Y_N$, voltage K8 and the following equation:

$$EO_N = (K8)\ (Y_N)\ (CHG_n);$$

first $RO_N$ signal means connected to the first $CHG_N$ signal means and to the first $EO_N$ signal means for subtracting signal $EO_N$ from signal $CHG_N$ to provide a signal $RO_N$, and first $EMR_N$ signal means connected to the first $CHG_N$ signal means, to the first $EO_N$ signal means, to the first $RO_N$ signal means and to the second switching means and receiving a direct current voltage K5, corresponding to a constant, for providing a signal $EMR_N$, corresponding to a new extract-mix recovery rate, to the second switching means in accordance with signals $CHG_N$, $RO_N$, voltage K5 and the following equation:

$$EMR_N = S_p + EO_N - (K5)\ (RO_N).$$

6. A system as described in claim 5 in which the second predicted parameter signal means includes second condutive means connected to the extract oil sensing means and to the second switching means for providing signal $EO_P$ to the second switching means as signal $EO_n$, first $T_N$ signal means connected to the temperature sensing means and to the second switching means and receiving voltage $\Delta T$, corresponding to a predetermined change in temperature, for providing a signal $T_N$, corresponding to a new decreased temperature, to the second switching means in accordance with signal $T_p$ and voltage $\Delta T$; second $F_n$ signal means connected to the first $T_N$ signal means and to the A/B signal means and receiving voltages K3 and K7 for providing an $F_N$ signal in accordance with the signals $T_N$ and A/B, voltages K3 and K7 and the following equation:

$$F_N = [(K3-T_N)/(S/B)\ ]^{K7};$$

second $C_N$ signal means connected to the second $F_N$ signal means and to the B signal means and receiving voltage K2 for providing a signal $C_N$ in accordance with signals B and $F_N$; voltage K2 and the following equation:

$$C_N = B/(F_N)^{K2};$$

second $Y_N$ signal means connected to the second $F_N$ signal means and the second $C_N$ signal means and receiving voltage K6 for providing a signal $Y_N$ in accordance with signals $F_N$ and $C_N$, voltage K6 and the following equation:

$$Y_N = (F_N)\ (C_N)\ (/K6-C_N);$$

second $CHG_N$ signal means connected to the second conductive means, to the second $Y_N$ signal means and to the second switching means and receiving voltage K1 for providing a signal $CHG_N$, corresponding to a new charge oil flow rate, to the second switching means in accordance with signals $EO_N$ and $Y_N$, voltage K1 and the following equation:

$$CHG_N = (EO_N)/(Y_N)\ (K1);$$

first means connected to the second $F_N$ signal means, to the second $CHG_N$ signal means and to the second switching means and receiving voltage K8 for providing a signal $S_N$, corresponding to a new solvent flow rate, to the second switching means in accordance with the signals $CHG_N$ and $F_N$, voltage K8 and the following equation:

$$S_N = (K8)\ (CHG_N)\ (F_N);$$

second $RO_N$ signal means connected to the second $CHG_N$ signal means and to the second conductive means for subtracting signal $EO_N$ from signal $CHG_N$ to provide a signal $RO_N$; and second $EMR_N$ signal means connected to the second $CHG_N$ signal means, to the second conductive means, to the second $RO_N$ signal means and to the second switching means and receiving voltage K5 for providing a signal $EMR_N$, corresponding to a new extract-mix recovery rate, to the second switching means in accordance with signal $CHG_N$, $EO_N$ and $RO_N$, voltage K5 and the following equation:

$$EMR_N = S_p + (K5)\ (RO_N).$$

7. A system as described in claim 6 in which the third predicted parameter signal means includes manually operative means for providing fifth and sixth control signals of different amplitudes, third switching means connected to the last mentioned control signal means and to the second switching means for passing signals provided to it to the second switching means when the fifth control signal is of one amplitude and for blocking those signals when the fifth control signal is of another amplitude, third conductive means connected to the solvent sensing means and to the third switching means for providing signal $S_p$ to the third switching means as signal $S_N$, third $T_N$ signal means connected to the temperature sensing means and to the third switching means and receiving a voltage $\Delta T$, corresponding to a predetermined change in temperature, for providing a signal $T_N$, corresponding to a new increased temperature, to the third switching means in accordance with signal $T_p$ and voltage $\Delta T$; third $F_N$ signal means connected to the third $T_N$ signal means and to the A/B signal means and receiving voltages K3 and K7 for providing a signal $F_N$ in accordance with the signals $T_N$ and A/B, voltages K3 and K7 and the following equation:

$$F_N = [(K3 - T_N)\ (A/B)\ ]^{K7};$$

third $CHG_N$ signal means connected to the solvent sensing means, to the third $F_N$ signal means and to the third switching means and receiving voltage K1 for providing a signal $CHG_N$, corresponding to a new charge oil flow rate, to the third switching means in accordance with signals $S_p$ and $F_N$, voltage K1 and the following equation:

$$CHG_N = (K1)\ (S_P)/(F_N);$$

third $C_N$ signal means connected to the third $F_N$ signal means and to the B signal means and receiving voltage K2 for providing a signal $C_N$ in accordance with signals B and $F_N$, voltage K2 and the following equation:

$$C_N = B/(F_N)^{K2};$$

third $Y_N$ signal means connected to the third $F_N$ signal means and the third $C_N$ signal means and receiving voltage K6 for providing a signal $Y_N$ in accordance with signal $F_N$ and $C_N$, voltage K6 and the following equation:

$$Y_N = (F_N)\ (C_N)/(K6 - C_N);$$

second $EO_N$ signal means connected to the third $CHG_N$ signal means, to the third $Y_N$ signal means and to the third switching means and receiving a direct current voltage K8 for providing signal $EO_N$, corresponding to a new extract oil flow rate, to the third switching means in accordance with signals $CHG_n$ and $Y_N$, voltage K8 and the following equation:

$$EO_N = (K8)\ (Y_N)\ (CHG_N);$$

third $RO_N$ signal means connected to the third $CHG_N$ signal means and to the second $EO_N$ signal means for substracting signal $EO_N$ from signal $CHG_N$ to provide a signal $RO_N$; and third $EMR_N$ signal means connected to the first $CHG_N$ signal means, to the $EO_N$ signal means, to the $RO_N$ signal means and to the third switching means and receiving voltage K5 for providing a signal $EMR_N$, corresponding to a new extract-mix recovery rate, to the third switching means in accordance with signals $CHG_N$, $EO_N$ and $RO_N$, voltage K5 and the following equation:

$$EMR_N = S_p + EO_N - (K5)\ (RO_N);$$

fourth switching means connected to the last mentioned control signal means and to second switching means for passing signals provided to it to the second switching means when the sixth control signal is of one amplitude and for blocking those signals when the fifth control signal is of another amplitude; fourth $T_N$ signal means connected to the temperature sensing means and to the fourth switching means and receiving voltage $\Delta T$, corresponding to a predetermined change in temperature, for providing a signal $T_N$, corresponding to a new decreased temperature, to the fourth switching means in accordance with signal $T_P$ and voltage $\Delta T$; fourth $F_N$ signal means connected to the fourth $T_N$ signal means and to the A/B signal means and receiving voltages K3 and K7 for providing a signal $F_N$ in accordance with the signals $T_N$ and A/B, voltages K3 and K7 and the following equation:

$$F_N = [(K3 - T_N)/(A/N)\ ]^{K7};$$

fourth $C_N$ signal means connected to the fourth $T_N$ signal means and to the B signal means and receiving voltage K2 for providing a signal $C_N$ in accordance with signals B and $F_N$, voltage K2 and the following equation:

$$C_N = B/(F_N)^{K2};$$

fourth $Y_N$ signal means connected to the fourth $F_N$ signal means and the fourth $C_N$ signal means and receiving voltage K6 for providing a signal $Y_N$ in accordance with signal $F_N$ and $C_N$, voltage K6 and the following equation:

$$Y_N = (F_N)\ (C_N)/(K6 - C_N);$$

fourth $RO_N$ signal means connected to the charge oil and extract oil sensing means for subtracting signal $EO_p$ form $CHG_p$ to provide signal $RO_p$, fourth $CHG_N$ signal means connected to the $RO_N$ signal means, to the fourth $Y_N$ signal means and to the fourth switching means and receiving voltage K1 for providing a signal $CHG_N$, corresponding to a new charge oil flow rate, to the fourth switching means in accordance with signals $RO_N$ and $Y_N$, voltage K1 and the following equation: ti $CHG = RO_N/(K_1\text{-}Y_N)$;

second means connected to the fourth $F_N$ signal means, to the fourth $CHG_N$ signal means and to the fourth switching means and receiving voltage K8 for providing a signal $S_N$, corresponding to a new solvent flow rate, to the fourth switching means in accordance with signals $CHG_N$ and $F_N$, voltage K8 and the following equation:

$$S_N = (K8)\,(CHG_N)\,(F_N);$$

and fourth $EMR_N$ signal means connected to the fourth $CHG_N$ signal means, to the fourth $EO_N$ signal means and to the fourth switching means and receiving voltage K5 for providing a signal $EMR_N$, corresponding to a new extract-mix recovery rate, to the second switching means in accordance with signals $CHG_N$, $EO_N$ and $RO_N$, voltage K5 and the following equation:

$$EMR_N = S_p + EO_N\text{-}(K5)\,(RO_N).$$

* * * * *

UNITED STATES PATENT AND TRADEMARK OFFICE

CERTIFICATE OF CORRECTION

PATENT NO. : 4,053,744

DATED : October 11, 1977

INVENTOR(S) : Robert A. Woodle

It is certified that error appears in the above-identified patent and that said Letters Patent are hereby corrected as shown below:

Col. 9, line 27: "for fixed" should read --for a fixed--

Col. 9, line 55: "$(S_p)(K1)CHG_p$" should read --$(S_p)(K1)/CHG_p$--

Col. 9, line 63: $EO_p(S_p+EO_p)$" should read --$EO_p/(S_p+EO_p)$--

Col. 10, lines 6, 8, 18, 23, 26, 28, 32 & 35:
"AB" should read --A/B--

Col. 10, line 14: "$AB = (K3-T_p)(F_p)^{K4}$" should read
--$A/B = (K3-T_p)/(F_p)^{K4}$--

Col. 11, lines 39, 41: "AB" should read --A/B--

Col. 11, line 44: "$[K3-T_N)/(A/B)]^{K7}$--

Col. 11, line 54: "$(K1)(S_p)(F_N)$" should read --$(k1)(S_p)/(F_N)$--

Col. 11, line 62: "$B(F_N)^{k2}$" should read --$B/F_N)^{k2}$--

UNITED STATES PATENT AND TRADEMARK OFFICE

CERTIFICATE OF CORRECTION

PATENT NO. : 4,053,744

DATED : October 11, 1977

INVENTOR(S) : Robert A. Woodle

It is certified that error appears in the above-identified patent and that said Letters Patent are hereby corrected as shown below:

Col. 13, line 26: "$S_p$+(K5)($RO_N$)" should read --$S_p$+$EO_N$-(K5)($RO_N$)--

Col. 14, line 53: "(A/N)" should read --(A/B)--.

Col. 15, line 10: "ti CHG" should read --CHG--

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*